United States Patent [19]

Morman et al.

[11] Patent Number: 4,692,371

[45] Date of Patent: Sep. 8, 1987

[54] HIGH TEMPERATURE METHOD OF MAKING ELASTOMERIC MATERIALS AND MATERIALS OBTAINED THEREBY

[75] Inventors: Michael T. Morman, Alpharetta, Ga.; Tony J. Wisneski, Kimberly, Wis.

[73] Assignee: Kimberly-Clark Corporation, Neenah, Wis.

[21] Appl. No.: 760,366

[22] Filed: Jul. 30, 1985

[51] Int. Cl.[4] ..... D01F 6/28; C08F 297/04

[52] U.S. Cl. ..... 428/224; 264/6; 264/12; 264/13; 264/DIG. 15; 428/220; 525/314; 528/481

[58] Field of Search ..... 525/314; 528/481; 428/220, 224

[56] References Cited

U.S. PATENT DOCUMENTS

| | | | |
|---|---|---|---|
| 3,576,913 | 4/1971 | Johnson et al. | 525/314 |
| 3,845,380 | 7/1974 | Harding . | |
| 3,849,241 | 11/1974 | Butin . | |
| 4,100,324 | 7/1978 | Anderson . | |
| 4,259,220 | 3/1981 | Bunnelle | 525/98 |
| 4,296,163 | 10/1981 | Emi | 428/212 |
| 4,305,990 | 12/1981 | Kelly | 428/220 |
| 4,323,534 | 4/1982 | Des Marais | 264/176 R |
| 4,355,425 | 10/1982 | Jones | 2/402 |
| 4,413,623 | 11/1983 | Pieniak | 604/365 |
| 4,418,123 | 11/1983 | Bunnelle | 428/517 |
| 4,450,026 | 5/1984 | Pieniak | 156/164 |

FOREIGN PATENT DOCUMENTS

| | | | |
|---|---|---|---|
| 54103466 | 2/1975 | Japan . | |
| 5590663 | 12/1978 | Japan . | |
| 1175192 | 12/1969 | United Kingdom | 525/314 |

OTHER PUBLICATIONS

Shell Material Safety Data Sheet 2,136 (4 pages), 2,031-1 (4 pages).

Superfine Thermoplastic Fibers, V. A. Wente, Ind. & Eng. Chem, pp. 1342-1346.

Manufacture of Superfine Organic Fibers, Wente & Boone, NRL Rept. 4364, (111437), Apr. 15, 1954.

Shell Technical Bulletin, SC:607-84, Kraton GX 1657.

Shell Technical Bulletin, SC:455-81, Kraton, Processing & Fabricating . . . .

Shell Technical Bulletin, SC:198-83, Kraton, An Extremely Versatile Polymer . . . etc.

Shell Technical Bulletin, SC:165-77, Shell Kraton Rubber for Modification of Thermoplastics.

Shell Technical Bulletin, SC:72-85, Solution Behavior of Kraton Thermoplastic Rubbers.

Shell Technical Bulletin, SC:68-85, Typical Properties, 1985.

Shell Technical Bulletin, SC:39-85, Kraton G1652.

Shell Technical Bulletin, SC:38-82, Kraton G1650.

*Primary Examiner*—Wilbert J. Briggs, Sr.

*Attorney, Agent, or Firm*—Joseph P. Harps

[57] ABSTRACT

Elastomeric materials such as elastomeric nonwoven webs of elastomeric meltblown fibers, elastomeric films or elastomeric molded materials are attained by forming, e.g., extruding or meltblowing, a polystyrenic poly(ethylenebutylene) thermoplastic block copolymer at elevated temperatures of at least about 290 degrees Centigrade, e.g., from about 290 degrees Centigrade to 345 degrees Centigrade. The resulting products retain good elastic elongation and strength properties. In the case of elastomeric nonwoven webs of elastomeric fibers, other fibers such as cellulosic fibers, e.g., cotton fibers, may be combined with the elastomeric fibers by known methods to provide an elastomeric nonwoven web comprising a blend of the elastomeric fibers with other fibers. Such web or film materials are useful generally in applications utilizing webs or sheets of elastic fabrics or the like, for example, in making composite materials in which an elastic layer of material is bonded to a gatherable web.

12 Claims, 4 Drawing Figures

HIGH TEMPERATURE METHOD OF MAKING ELASTOMERIC MATERIALS AND MATERIALS OBTAINED THEREBY

BACKGROUND OF THE INVENTION

1. Field of the Invention

The present invention is concerned with elastomeric materials and methods of making them, including meltblowing methods for making elastomeric fiber nonwoven mats, and is more particularly concerned with such materials made at high temperatures from an extrudable composition comprising a particular class of styrenic elastomeric rubbers.

2. Description of the Related Art

Meltblowing techniques for forming from thermoplastic resins very small diameter fibers, sometimes referred to as microfibers or meltblown fibers, are well-known in the art. For example, the production of fibers by meltblowing is described in an article entitled "Superfine Thermoplastic Fibers", appearing in *Industrial and Engineering Chemistry,* Vol. 48, No. 8, pp. 1342–1346. This article describes work done at the Naval Research Laboratories in Washington, D.C. Another publication dealing with meltblowing is *Naval Research Laboratory Report* 111437, dated Apr. 15, 1954. Essentially, the meltblowing technique comprises heating a thermoplastic fiber-forming resin to a molten state and extruding it through a plurality of fine orifices into a high velocity heated gas (air) stream which attenuates the threads of molten resin being extruded through the fine orifices to form meltblown fibers of a diameter less than the diameter of the orifices. U.S. Pat. No. 3,849,241 discloses the manufacture of nonwoven mats by meltblowing and describes, starting at column 4, line 57, meltblowing fibers by extruding degraded fiber-forming thermoplastic polymer resins having diameters of from about 0.5 to about 400 microns. The patent discloses that the diameter of the attenuated fibers will decrease as the gas flow rate (through the gas outlets which are located on either side of the orifices) increases. The patent further notes that at low to moderate rates of gas flow the extruded fibers are essentially continuous with little or no fiber breaks and that fibers produced in such low to moderate gas flow rate regimes have diameters of, preferably, from about 8 to 50 microns. This patent also discloses that the fiber-forming thermoplastic polymers are subjected to controlled thermal and oxidative degradation at temperatures of from about 550° F. to 900° F. (288° C. to 482° C.), preferably from about 600° F. to 750° F. (316° C. to 399° C.) for a period of time to cause the requisite extent of resin degradation. Typical fiber-forming thermoplastic resins are listed at column 4, line 35 et seq and commercially useful resin throughout rates are stated to be from about 0.07 to 5 grams per minute per nozzle orifice, preferably at least 1 gram per minute per nozzle orifice. Degradation of such resins is necessary in order to reduce their viscosity sufficiently for extrusion and attenuation by the high velocity gas stream.

Of course, there is a limit to the degree of degradation which can be imposed on a given resin without unduly adversely affecting the desired properties of the product obtained therefrom. This is particularly so in the case of elastomeric fiber-forming resins such as styrenic ethylene-butylene block copolymers where degradation of the tri-block copolymer can result in the formation of a di-block material which is non-elastic. For example, Technical Bulletin SC: 38-82 (October, 1982) and SC: 39-85 (January, 1985) of Shell Chemical Company, Houston, Tex. in describing the styrenic ethylene-butylene rubbers sold by it under the trademark KRATON, respectively state with respect to the materials designated as G 1650 and G 1652, that compounding temperatures of the rubber should not be allowed to exceed 525° F. (274° C.) and that a fire watch should be maintained if 475° F. (246° C.) is reached. With respect to the KRATON rubber designated GX 1657, Technical Bulletin SC: 607-84 (September, 1984) of Shell Chemical Company gives a warning not to allow the resin temperature to exceed 450° F. (232° C.) and to maintain a fire watch should that temperature be reached. Material Safety Data Sheets 2,136 (Revised 1-83) and 2,031-1 (Revised 1-83) of Shell Chemical Company state respectively for the GX 1657 and G 1652 materials that processing temperature of the resin should not be allowed to exceed 550° F. (287.8° C.) and a fire watch should be maintained if that temperature is reached. Shell Chemical Company Technical Bulletins SC: 65-75 "KRATON Thermoplastic Rubber" and SC: 72-85 (March, 1985) "Solution Behavior Of KRATON G Thermoplastic" are among numerous publications of Shell Chemical Company which give detailed information concerning various grades of KRATON thermoplastic rubbers. The KRATON thermoplastic rubbers are A-B-A block copolymers in which the A endblocks are polystyrene and the B midblock is either poly(ethylene-butylene) (KRATON G grades, sometimes referred to as "S-EB-S" resins) or polyisoprene or polybutadiene (KRATON D grades).

Shell Chemical Company Technical Bulletin SC: 198-83, (Revised 7-83) at page 19, gives examples of commercially available resins and plasticizers useable with KRATON rubber formulations, distinguishing between rubber phase (B midblock)-associating materials and polystyrene phase (A endblock)-associating materials.

U.S. Pat. No. 4,323,534 (des Marias) discloses a process for meltblowing a blend of an A-B-A block copolymer wherein B is poly (ethylene-butylene) and A may be, for example, polystyrene or poly(alpha methylstyrene) with from about 20 percent to 50 percent, by weight, of a fatty chemical such as stearic acid. KRATON materials, as described above, are exemplified as the A-B-A block copolymer material. An extrusion temperature range of up to 240° C. (column 8, line 64 et seq) is disclosed for the meltblowing operation, which temperature range is generally within that recommended by the above-mentioned Shell Chemical Company technical bulletins. In order to improve the physical properties of the meltblown material, substantially all the fatty chemicals are leached out of the nonwoven mat of extruded microfibers by soaking the mat in alcohols having good solubility for the fatty chemical utilized.

U.S. Pat. No. 4,355,425 (Jones) discloses an undergarment which may be made of a fiber formed by meltblowing a blend of a KRATON G rubber with a fatty chemical such as stearic acid. The examples are apparently limited to KRATON G 1652 block copolymer. An extrudable composition stated to be particularly useful for the purpose (column 4, line 24 et seq) is a blend of KRATON G 1652 rubber and 20 percent by weight stearic acid as well as other ingredients. The disclosed extrusion temperature of 390 degrees Farhrenheit (199° C.) for the composition (column 5, lines 14 and 19) is within the temperature range set forth in the above-mentioned Shell Chemical Company technical bulletins. It is further stated that fibers for making the material can be meltblown as taught in U.S. Pat. No. 3,825,380, which discloses a die configuration said to be suited for meltblowing fibers. It should also be noted that the procedures of Jones, as was the case with the procedures of des Marais, indicate the desirability of leaching out the fatty chemical after formation of a fibrous nonwoven web or film from the blend of fatty chemical and KRATON G. See, for example, column 5, lines 60 et seq.

DEFINITIONS

The terms "elastic" and "elastomeric" are used interchangeably herein to mean any material which, upon application of a biasing force, is stretchable to a stretched, biased length which is at least about 125 percent, that is about one and one quarter, of its relaxed, unbiased length, and which will recover at least 40 percent of its elongation upon release of the stretching, elongating force. A hypothetical example which would satisfy this definition of an elastomeric material would be a one (1) inch sample of a material which is elongatable to at least 1.25 inches and which, upon being elongated to 1.25 inches and released, will recover to a length of not more than 1.15 inches. Many elastic materials may be stretched by much more than 25 percent of their relaxed length and many of these will recover to substantially their original relaxed length upon release of the stretching, elongating force and this latter class of materials is generally preferred for purposes of the present invention.

As used herein the term "recover" refers to a contraction of a stretched material upon termination of a biasing force following stretching of the material by application of the biasing force. For example, if a material having a relaxed, unbiased length of one (1) inch was elongated 50 percent by stretching to a length of one and one half (1.5) inches the material would have been elongated 50 percent and would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein the term "nonwoven web" means a web of material which has been formed without use of weaving processes which produce a structure of individual fibers or threads which are interwoven in an identifiable repeating manner. Nonwoven webs have been, in the past, formed by a variety of processes such as, for example, meltblowing processes, spunbonding processes, film aperturing processes and stable fiber carding processes.

As used herein the "styrenic moiety" refers to the monomeric unit represented by the formula:

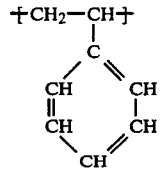

As used herein the term "poly (ethylene-butylene)" refers to a polymer segment or block represented by the formula:

poly(ethylene-butylene)

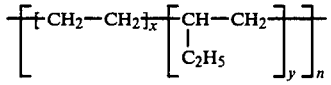

where x, y and n are positive integers.

As used herein the term "polystyrene" refers to a polymer segment or block represented by the formula:

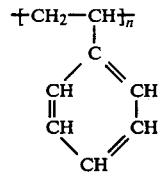

polystyrene where n is a positive integer.

SUMMARY OF THE INVENTION

In accordance with the present invention there is provided a method for making an elastic, that is elastomeric material, for example, an elastomeric nonwoven mat of elastomeric fibers or an elastomeric film, the method comprising the steps of: (i) heating to a temperature of at least about 290° C. a composition substantially composed of an A-B-A′ block copolymer wherein A and A′ are the same or different thermoplastic endblocks or segments and each contains a styrenic moiety, for example, each endblock may be selected from the group including polystyrene and polystyrene homologs, and B comprises a poly(ethylene-butylene) midblock or segment, and (ii) forming, e.g., extruding, the composition while it is still at a temperature of at least about 290° C. to provide the elastomeric material. For example, the material may be provided by (a) extruding it as a film or (b) extruding it through a plurality of extrusion orifices into a gas stream which attenuates the extrudate from the orifices to provide a gas-borne stream of fibers, and then collecting the stream of fibers to form an elastomeric nonwoven mat of elastomeric fibers. The gas stream may be an inert or at least a nonoxidizing gas, e.g., nitrogen.

In another aspect of the invention, each of A and A′ is selected from the group including polystyrene and poly(alpha methylstyrene).

In yet another aspect of the invention the block copolymer may be one in which the sum of the molecular weight of A with the molecular weight of A′ comprises not more than about 29 percent, e.g., from about 14 to 29 percent, of the molecular weight of the A-B-A′ block copolymer.

The composition includes only the A-B-A′ block copolymer and additives such as pigments, antioxidants, stabilizers, surfactants, solid solvents and particulates. Preferably the composition includes at least about 90 percent, by weight, of the A-B-A′ block copolymer and no more than about 10 percent, by weight, of the additives such as pigments, antioxidents, stabilizers, surfactants, solid solvents and particulates. For example, the composition would include at least about 95 percent, by weight, of the A-B-A′ block copolymer and about 5 percent, by weight, of the additives, more particularly, the composition would include at least about 99 percent, by weight, of the A-B-A′ block copolymer and about 1 percent, by weight, of additives. The composition can be composed of 100 percent, by weight, of A-B-A′ block copolymer.

Other aspects of the invention provide one or more of the following characteristics: A and A′ may be the same; the composition may be heated to a temperature in the range of from about 290° C. to 345° C., preferably from about 300° C. to 335+ C., and extruded or otherwise formed while it is in such temperature range; the elastomeric fibers may be of a diameter of from about 0.5 micron to 100 microns, preferably from about 1 micron to 50 microns; and the method may include maintaining the velocity of the gas stream and the temperature of the extrudable composition so as to form essentially continuous fibers.

The invention is also directed to an elastomeric material, e.g., an elastomeric film or an elastomeric nonwoven mat of elastomeric fibers which is obtained by forming, e.g., extruding, the composition at a temperature of at least about 290 degrees Centigrade, for example, of from about 290° C. to about 345+ C., preferably, from about 300° C. to about 335° C. If an elastomeric nonwoven web is to be formed, the forming includes extruding the extrudable composition through a plurality of extrusion orifices into a gas stream, which may be formed of an inert or at least a non-oxidizing gas, e.g., nitrogen, which attenuates the extrudate from the orifices to provide elastomeric fibers of the A-B-A′ block copolymer as described above. As used herein and in the claims, extrudable composition means a composition which can be shaped or formed (as by molding or extruding) and then will solidify to provide a shaped or formed solid material such as the elastomeric materials of the present invention. If an elastomeric film is to be formed, the forming includes extruding the extrudable composition from a film-forming die as, for example, a sheet and, if desired, drawing the sheet down by a conventional arrangement to a desired film thickness. Thereafter the elastomeric film may be cooled by, for example, quenching in a bath of cooling water. For example, the elastomeric material may comprise an elastomeric film of not greater than about 25 mils, preferably not greater than about 10 mils thickness, or the elastomeric material may comprise an elastomeric nonwoven web of elastomeric fibers of an average fiber diameter of about 0.5 to 100, preferably about 1 to 50 microns.

Other aspects of the invention include elastomeric materials made by the methods described above. Still other aspects of the invention are described in the following detailed description of the invention.

DESCRIPTION OF THE PREFERRED EMBODIMENTS

Figure 1:
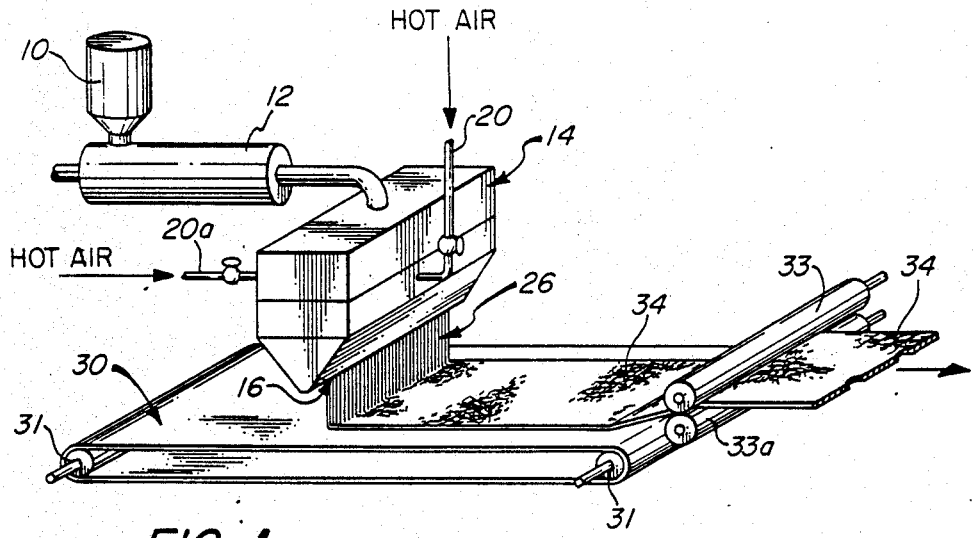
FIG. 1 is a perspective schematic view showing meltblowing apparatus of the type useable in accordance with one aspect of the invention.

The methods and compositions of the invention have broad application in the forming of elastomeric materials by any suitable method such as molding or extrusion, e.g., extruding films or fibers. A particularly useful method, however, is to meltblow fibers to form an elastomeric nonwoven web of elastomeric fibers.

As indicated above, meltblowing processes generally involve extruding a thermoplastic resin through a plurality of fine orifices in a meltblowing die as threads into a gas stream which is flowing generally in the same direction as the material being extruded from the orifices so that the extruded threads are entrained by the gas stream as they emerge from the orifices and are attenuated, i.e., drawn down to reduce their diameter, and borne away from the die by the gas stream. The gas stream is directed onto a foraminous member, such as a screen belt or drum moving over a vacuum box, so that the gas-borne fibers impinge upon and are collected on the moving screen or drum to form a mat or web of nonwoven meltblown fibers. Conventional meltblowing die construction accordingly includes a longitudinally extending die in which the plurality of fine meltblowing orifices are arranged linearly along the die face, which is approximately as wide as the desired width of the web to be produced. The diameter of the meltblowing orifices will generally be on the order of about 0.01 to 0.02 inches in diameter, for example, about 0.015 inches, with the length of the orifices being from about 0.05 inches to about 0.20 inches, for example, about 0.113 inches to about 0.14 inches long, and from about 5 to 50 such orifices will be provided per linear inch of orifice array. For example, from 9 to 30 or more orifices may be provided per linear inch of orifice array. A typical meltblowing die may be, say, 30 to 60 or more inches wide. As a result of the above-discussed linear orifice arrangement, meltblowing dies, in the vicinity of the orifices, are usually held together only by a thin and relatively fragile spaced-apart portions of metal between adjacent meltblowing orifices. Consequently, controlling the pressure within the die of the molten thermoplastic resin as it is extruded through the die and thus through the orifices is important in order to avoid rupturing of the die. It is therefore preferred, at least for dies of such conventional design, that the pressure of the molten thermoplastic resin within the die not be more than about 300 pounds per square inch, gage (psi,g) more preferably not more than about 200 psi,g. As indicated above, it is known to utilize thermal and oxidative degradation of the thermoplastic resin order to reduce its viscosity and hence, for a given set of processing conditions, reduce the pressure of the thermoplastic resin within the die.

The high viscosity of the block copolymers employed in the present invention, e.g., the KRATON S-EB-S block copolymers described above, render it difficult to extrude or otherwise form them, and render it particularly difficult to extrude them as fibers or microfibers, such as by meltblowing them in molten form.

(As used herein and in the claims, microfibers are defined as fibers of not more than about 100 microns in diameter). This difficulty has engendered the prior art expedients as discussed in the above-identified patents to Jones and des Marais which suggest the use of fatty chemical additives to facilitate extrusion meltblowing or film-extruding of the styrenic elastomeric S-EB-S block copolymers described therein. However, both Jones and des Marais suggest that the fatty chemicals should be leached out from the resultant material.

It has now been found that such styrenic S-EB-S materials can be formed, for example, meltblown, without the necessity of adding viscosity reducing additives at temperatures higher than the highest temperature recommended by a manufacturer of the material, to provide satisfactory elastomeric materials. The increased temperature helps to reduce the viscosity of the thermoplastic styrenic block copolymer which facilitates the meltblowing of the material into elastomeric fibers or other materials having good elastic and other properties. The elastomeric fibers may be collected and formed into an elastomeric nonwoven web. The resultant product may thus be made without addition of viscosity-reducing additives to yield a substantially 100 percent block copolymer product, or one containing only desired additives sucha s pigments, dyes, deoxidizers, extenders and the like, and as used herein, the term "consisting essentially of" does not exclude the presence of additional materials which do not significantly affect the elastic properties and characteristics of a given composition. Exemplary materials of this sort would include, without limitation, pigments, antioxidants, stabilizers, surractants, waxes, flow promoters, solid solvents, particulates and materials added to enhance processability of the composition. Significantly, there is no necessity of post treatment, such as leaching, to remove viscosity-reducing additives from the meltblown material.

The block copolymer resin and any additives which are used in the composition must be able to sustain the high temperatures utilized by the present invention without deleterious thermal vaporization, chain scission or excessive thermal or oxidative degradation. In this regard it is believed that the degree of oxidative degradation sustained by the composition may be reduced by using an inert gas as the attenuating gas stream in the meltblowing step. It is also believed that the degree of oxidative degradation can be reduced by blanketing the raw pellets of the resins utilized with an inert gas prior to their processing by an extruder. As used herein and in the claims, an "inert gas" is one which is a non-oxidizing gas and is not otherwise harmful to the materials being formed. Nitrogen is particularly useful in this regard. The fact that the amount of oxidative degradation which the block copolymer undergoes during extrusion may be reduced by using an inert gas as the attenuating gas stream is generally implied by thermogravimetric analyses of KRATON GX 1657 block copolymer resin which were carried out in air and nitrogen. In these analyses samples of the KRATON GX 1657 block copolymer resin, when heated in air, showed a weight loss beginning at about 307 degrees Centigrade whereas a comparison sample heated in nitrogen showed only a weight loss starting at about 375 degrees Centigrade. It is believed that these results indicate that the effects of oxidative degradation on the sample heated in air could be avoided or diminished by use of an inert or, at least, a non-oxidizing attenuating gas stream to thus limit degradation of the extrudable composition during attenuation at high attenuating gas temperatures and/or by use of an inert or, at least, non-oxidizing gas to blanket the raw pellets. Oxidative degradation of the extrudable composition may thus be limited without sacrificing high attenuating gas temperatures.

As noted above, generally, although the compositions of the invention may be composed of substantially 100 percent of the block copolymer, they may also contain known useful additives such as pigments, plasticizers and the like but these will normally be present in minor amounts such as less than about 15 percent or less by weight of the total composition. For example, the additives may be present in minor amounts of less than about 10 percent, by weight, of the composition. That is, the additives may be present in minor amounts of less than about 5 percent, by weight, of the composition. More specifically, the additives may be present in minor amounts of less than about 1 percent, by weight, of the composition. The compositions of the invention are preferably free of viscosity-reducing agents or other extrusion aids such as those which must be leached or otherwise removed from the composition after forming thereof by, for example, meltblowing or film extrusion. For example, the compositions of the invention are free of significant amounts of fatty chemicals such as stearic acid and the like utilized as an extrusion aid as taught in the patents to Jones and des Marais as described above.

The block copolymer resin should also be free of polymer domains which do not melt or which crosslink at the high temperatures utilized, either phenomenon being undesirable in formina an elastomeric material from an extrudable composition. For example, unmelted or crosslinked particles would tend to plug up fine orifices or die slits or gaps through which the composition is to be extruded. Of the A-B-A' block copolymers described above, those in which the B midblock is composed of polyisoprene tend, at the high temperatures used herein, to degrade to a non-elastic di-block molecule. Those in which the B midblock is composed of polybutadiene tend, at the high temperatures used herein, to crosslink. Accordingly, these block copolymers are not believed to be suitable for use in the present invention since they cannot be processed satisfactorily at temperatures in excess of 290 degrees Centigrade.

A preferred class of the A-B-A' block copolymers, described above, is that in which A and A' are thermoplastic endblocks selected from the group including polystyrene and polystyrene homologs such as poly(alpha methylstyrene). Such materials are commercially available from the Shell Chemical Company under the trade designation KRATON G, described above, and are sometimes herein referred to as "S-EB-S" (polystyrene/poly(ethylenebutylene)/polystyrene) block copolymers. KRATON block copolymer materials are described in detail in a number of Shell Chemical Company publications including one designated SC: 198-83, 7/83 5M. KRATON G 1650 rubber has a weight ration of polystyrene A and A' endblocks to poly(ethylenebutylene) B midblocks of 28:72, that is the sum of the molecular weight of the A endblock with the molecular weight of the A' endblock is 28 percent of the molecular weight of the A-B-A' block copolymer; for KRATON G 1652 block copolymer the weight ratio is 29:71 and for KRATON GX 1657 the weight ratio is 14:86. It is believed that these block copolymers do not contain plasticizer oils although compounded KRATON G block copolymers are also commercially available from Shell. The G 1650 and G 1652 block copolymers are available in crumb form and have a specific gravity of about 0.81 and a Shore A Hardness of about 75. The GX 1657 block copolymer is available in pellet form, has a specific gravity of about 0.90 and a Shore A Hardness of about 65. Such materials have been found to be satisfactory for meltblowing at high extrusion temperatures and to produce elastomeric materials, particularly, elastomeric films and elastomeric fibers, more particularly, elastomeric microfibers. The S-EB-S block copolymer has also been found, when blended with certain polyolefins, to provide materials having satisfactory elastic and strength properties. In this regard reference is made to U.S. patent application Ser. No. 760,698 now U.S. Pat. No. 4,663,220, of T. J. Wisneski et al, entitled "Method of Making Polyolefin-Containing Elastomeric Materials And Materials Obtained Thereby", the disclosure of which is incorporated herein by reference.

Figure 1A:
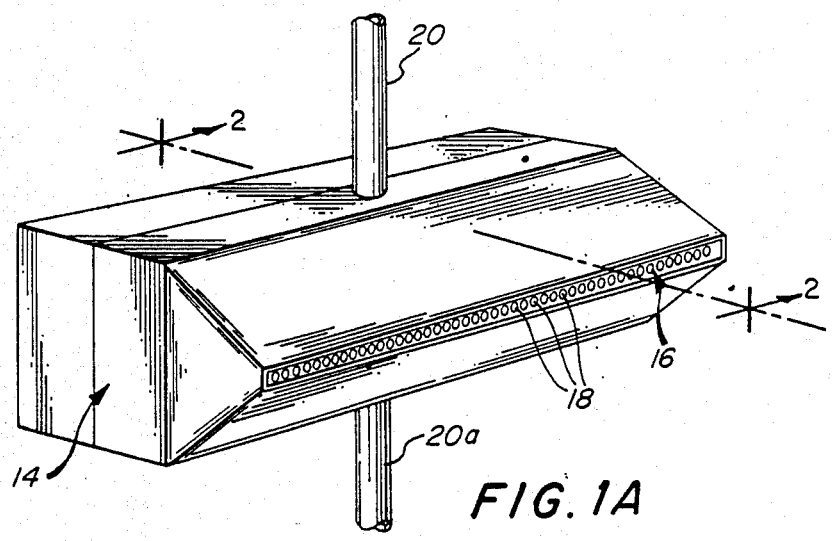
FIG. 1A is a perspective schematic view of the meltblowing die of the apparatus of FIG. 1.
Figure 2:
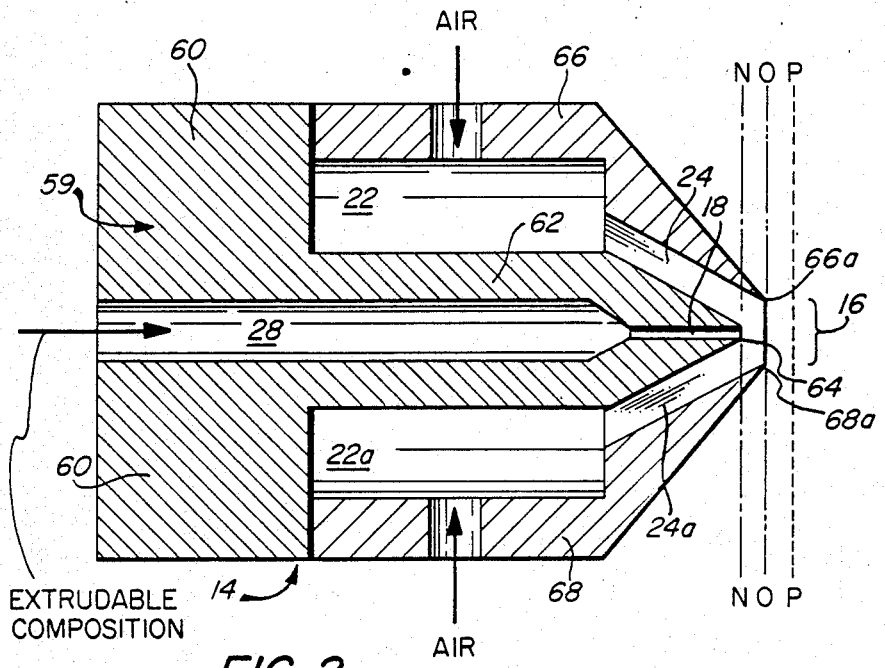
FIG. 2 is an enlarged schematic cross-section taken along line 2—2 of FIG. 1A.
Figure 3:
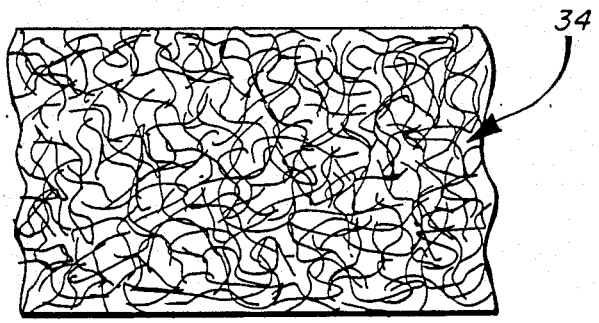
FIG. 3 is a schematic plan view of a segment of a nonwoven web of elastomeric fibers in accordance with one aspect of the invention.

Referring now to FIG. 1, an extruder 12 is supplied with pellets (not shown) of an A-B-A′ block copolymer where A and A′ are each thermoplastic endblocks containing a styrenic moiety and B is a poly(ethylene-butylene) midblock, as defined herein, from a supply hopper 10. Any additives, as defined herein, which are to be included should also be added to the hopper 10 at this time. The hopper 10 may be blanketted with an inert gas (not shown) to aid in limiting to oxidative degradation of the composition. The pellets are melted within a conventional extruder 12 by a conventional heating arrangement (not shown) to form a molten extrudable composition which is extruded through a meltblowing die 14 by the action of a turning extruder screw (not shown) located within the extruder 12. The face 16 of the die 14 contains a plurality of meltblowing die orifices 18 (FIGS. 1A and 2) which are arranged in a linear array across the face 16 as is best seen in FIG. 1A. Inlets 20, 20*a* (FIGS. 1 and 1A) feed heated air or heated inert gas to the plenum chambers 22, 22*a* (FIG. 2) which air or inert gas then exits, respectively, through the passages 24, 24*a* to converge and form a gas stream which attenuates and entrains the polymer threads extruded from the orifices 18 to form a gas-borne stream of fibers 26 (FIG. 1). As shown in FIG. 2, the extrudable composition is fed to the orifices 18 through extrusion slot 28. The die 14 and the gas supply fed therethrough are heated, by a conventional arrangement (not shown). The gas-borne stream of fibers 26 is projected onto a collecting device which, in the embodiment illustrated in FIG. 1, includes a foraminous endless belt 30 carried on rollers 31 and which may be fitted with one or more stationary vacuum chambers (not shown) located beneath the collecting surface on which an elastomeric nonwoven web 34 of elastomeric fibers is formed. The stationary vacuum chambers beneath the collecting surface of belt 30 receive and conduct away the air or gas stream separated from the fibers by belt 30. Tip 64 (FIG. 2) of meltblowing die 14 is typically about 4 to 24 inches (10.2 to 61.0 cm) from the surface of belt 30 on which the fibers are initially collected. The collected, entangled fibers form a coherent web 34, a segment of which is shown in plan view in FIG. 3. FIG. 3 generally illustrates that the web 34 is formed of a matrix of entangled cohesive fibers. In the illustrated embodiment, the web 34 is shown as being removed from belt 30 by a pair of pinchrolls 33 and 33*a* which press the entangled fibers together and may help in forming the web. However, it should be noted that the material of the invention provides cohesive webs and such pinchroll treatment is optional. The apparatus illustrated is typical of known meltblowing equipment and the web 34, which optionally may be pattern-embossed as by ultrasonic embossing equipment (not shown), may thereafter be taken up on a storage roll or passed to subsequent manufacturing steps (not shown). Other embossing means may be utilized, such as the pressure nip formed between a calender and anvil roll, or the embossing step may be omitted altogether.

As an entirely optional feature, not necessary to the practice of the invention but merely illustrating a further embodiment thereof, it is possible to combine, by known techniques, other fibers such as pulp or cellulosic fibers or nonfibrous material such as particulates with the elastomeric meltblown fibers by mixing them into the gas-borne stream of elastomeric meltblown fibers 26. For example, such mixing may be carried out in the manner disclosed in U.S. Pat. No. 4,100,324, the subject matter of which is hereby incorporated by reference, in which a pulp material is provided to a picker roll having thereon teeth which serve to fiberize the pulp material into separate pulp fibers which are conveyed through a duct and into a gas-borne stream of meltblown fibers by process air supplied from a suitable source. Apparatus of this type may generally be utilized to intermingle pulp or other fibers with the gas-borne stream 26 of meltblown elastomeric fibers so that the combined fibers are deposited the upon collector belt 30. If particulates are to be added to the stream 26 of meltblown elastomeric fibers other conventional arrangements may be utilized.

Referring now to FIG. 2, the meltblowing die 14 is seen to include a die member 59 having a base portion 60 and a proturding central portion 62 within which an extrusion slot 28 extends in flow communication with the plurality of orifices 18, the outer ends of which terminate at the die tip 64. An upper air plate 66 and a lower air plate 68 are affixed by means (not shown) to the die member 59 and are so shaped and configured relative thereto to define therebetween the plenum chambers 22, 22*a* and their respectively associated air passages 24, 24*a*. Upper air plate 66 terminates in a lip 66*a* and lower air plate 68 terminates in a lip 68*a*. In the illustrated configuration, the die tip 64 is seen to lie in the plane N—N, which plane is recessed inwardly of the plane O—O within which the lips 66*a* and 68*a* lie. In this configuration the perpendicular distance between planes N—N and O—O comprise a "negative stick-out" of the die tip 64; such negative stick-out distances are indicated herein in negative numbers. In embodiments in which the die tip 64 protrudes outwardly of the plane O—O, for example, as by lying within the plane P—P shown in dotted lines in FIG. 2, a "positive stick-out" of die tip 64 is said to exist and such values are indicated herein by giving the perpendicular distance between planes O—O and P—P as a positive number. The "air gap" is the minimum opening provided by air passages 24 and 24*a*, which are usually substantially identical.

EXAMPLE 1

Extrudable compositions were prepared by heating an S-EB-S block copolymer sold under the trademark KRATON GX 1657 by the Shell Chemical Company and meltblown by being extruded through a meltblowing die into an attenuating gas stream to form fibers which were collected on a collecting screen to form an elastomeric nonwoven coherent web of entangled elastomeric fibers. The block copolymer was heated to provide an extrudable composition which was extruded through a meltblowing die having an orifice array 1⅝ inches (4.13 cm) in length. The extrusion orifices of the meltblowing die were 0.0145 inches in diameter and 0.113 inches in length, and the meltblowing die was provided with 9 such orifices per linear inch of orifice array for a total of 14 orifices. The air gaps were set at 0.060 inches (1.524 mm) and a die tip stick-out of 0.035 inches (0.889 mm) was used in all runs, with a distance of 12 inches (30.48 cm) between the die tip and the collecting screen. An arrangement as shown in FIG. 1 of the drawings was used, with the die tip pointed vertically downward at the collecting screen which was a horizontally positioned moving endless belt. The attenuating gas stream was air in all runs and the temperature and gauge pressure at which the air was supplied is indicated in Table I which also shows the pressure and viscosity of the extrudable composition within the orifices of the die. The following legends apply to Table I:

TP=throughput, i.e., the average rate of extrusion of the extrudable composition through each of the die orifices, measured in grams per minute per orifice.

T(EC)=the temperature of the extrudable composition in the die, in degrees Centigrade.

T(Air)=the temperature of the attenuating air stream, in degrees Centigrade.

P(Air)=the pressure at which the attentuating air was supplied measured in pounds per square inch, gauge.

P(DT)=the pressure of the extrudable composition in the orifices of the die, measured in pounds per square inch, gauge.

VISC.=the viscosity of the extrudable composition in the orifices of the die, calculated in poise.

NOTE: For purpose of calculating viscosity, the density of the molten extrudable composition was assumed to be constant at 0.73 grams per cubic centimeter.

Elastomeric nonwoven webs of elastomeric fibers were produced from the KRATON GX-1657 block copolymer, discussed above, in accordance with Example I and under the process conditions set forth in Table I, below.

TABLE I

| | Run 1 | Run 2 | Run 3 | Run 4 | Run 5 |
|---|---|---|---|---|---|
| TP | 0.05 | 0.05 | 0.05 | 0.05 | 0.079 |
| T(EC) | 288.9 | 303.3 | 318.3 | 318.3 | 318.3 |
| T(Air) | 269.4 | 273.9 | 275.0 | 291.1 | 291.1 |
| P(Air) | 2 | 2 | 2 | 2 | 2 |
| P(DT) | 385 | 294 | 269 | 194 | 280 |
| VISC. | 3,656 | 2,792 | 2,554 | 1,842 | 1,683 |
| | **Run 6** | **Run 7** | **Run 8** | **Run 9** | **Run 10** |
| TP | 0.107 | 0.05 | 0.079 | 0.107 | 0.132 |
| T(EC) | 318.3 | 331.1 | 331.1 | 331.1 | 331.1 |
| T(Air) | 291.1 | 287.8 | 287.8 | 287.8 | 287.8 |
| P(Air) | 2 | 2 | 2 | 2 | 2 |
| P(DT) | 335 | 148 | 210 | 262 | 297 |
| VISC. | 1,486 | 1,405 | 1,262 | 1,163 | 1,068 |

Each of Runs 1–7 produced coherent elastomeric nonwoven webs of elastomeric fibers which displayed satisfactory characteristics of elasticity and tensile strength. Samples of nonwoven elastomeric webs for runs 8, 9 and 10 were not collected since these runs were directed at determining polymer shear rate sensitivity by rapidly varying the throughput. To exemplify this fact nonwoven webs of KRATON GX 1657 elastomeric fibers made under conditions as described above in runs 1 through 7 were tested for elasticity and tensile strength as follows. Sample strips of the test material one inch wide by three inches long (2.54×7.62 cm) were cut from the web of sample material with the three inch long sides extending substantially parallel to the machine direction. Elongation of the samples was tested in a properly calibrated Model 1122 Instron testing device by clamping the one inch wide ends of the test sample in the jaws of the device. The samples were repeatedly stretched to 100 percent elongation, that is, to twice their unstressed length, and the work required to attain such elongation (inch-pounds) was measured. The samples were allowed to relax between elongations. All stretching was carried out at five inches per minute (12.7 cm per minute) crosshead speed of the Instron tester and the initial jaw span was one inch (2.54 cm). After four such elongations all samples were stretched to failure in the fifth elongation and the elongation at failure was measured.

The following legends apply to Table II:

TEA=total energy absorbed, i.e., the work required to elongate the sample 100 percent for the first four tests on each sample and to elongate it to break on the fifth test on each sample, in inch-pounds. (See note below).

TL=tensile load on of the sample at (1) 100 percent elongation, in pounds for the first four tests on each sample and (2) the peak load to break for the fifth test on each sample. (See not below).

EF=elongation of the sample at failure, in inches.

BW=basis weight of the sample tested, in grams per square meter.

N=The number of test repetitions which were averaged to determine the values reported for each sample of that run.

S.D.=The standard deviation of the test values for each sample.

Note: TEA and TL data in TABLE II are standardized to a sample of 100 grams per square meter basis weight.

TABLE II

| Test No. | TEA | (S.D.) | TL | (S.D.) | EF |
|---|---|---|---|---|---|
| | Sample 1 (Run 1) BW = 120.9 N = 6 | | | | |
| 1-1 | 0.1243 | (.027) | 0.2298 | (.034) | — |
| 1-2 | 0.1062 | (.023) | 0.2120 | (.044) | — |
| 1-3 | 0.1000 | (.023) | 0.2070 | (.043) | — |
| 1-4 | 0.0975 | (.023) | 0.2040 | (.043) | — |
| 1-5 | 2.865 | (.650) | 0.5985 | (.132) | 7.505 |
| | Sample 2 (Run 2) BW = 110.3 N = 3 | | | | |
| 2-1 | 0.1053 | (.026) | 0.1896 | (.0312) | — |
| 2-2 | 0.0867 | (.020) | 0.1816 | (.0288) | — |
| 2-3 | 0.0824 | (.019) | 0.1754 | (.0279) | — |
| 2-4 | 0.0784 | (.018) | 0.1726 | (.0270) | — |
| 2-5 | 1.864 | (.159) | 0.3980 | (.0169) | 6.621 |
| | Sample 3 (Run 3) BW = 215.8 N = 4 | | | | |
| 3-1 | 0.1045 | (.061) | 0.2014 | (.0610) | — |
| 3-2 | 0.0953 | (.029) | 0.1914 | (.0579) | — |
| 3-3 | 0.0902 | (.028) | 0.1859 | (.0560) | — |
| 3-4 | 0.0744 | (.048) | 0.1812 | (.0546) | — |
| 3-5 | 2.068 | (.517) | 0.4037 | (.1104) | 7.239 |
| | Sample 4 (Run 4) BW = 202.9 N = 4 | | | | |
| 4-1 | 0.0987 | (.017) | 0.1827 | (.0308) | — |
| 4-2 | 0.0828 | (.013) | 0.1747 | (.0305) | — |
| 4-3 | 0.0785 | (.013) | 0.1704 | (.0304) | — |
| 4-4 | 0.0759 | (.013) | 0.1671 | (.0299) | — |
| 4-5 | 2.011 | (.653) | 0.3917 | (.1208) | 7.136 |
| | Sample 5 (Run 5) BW = 343.1 N = 2 | | | | |
| 5-1 | 0.1408 | (.056) | 0.2257 | (.0838) | — |
| 5-2 | 0.1096 | (.041) | 0.2128 | (.0793) | — |
| 5-3 | 0.1027 | (.039) | 0.2054 | (.0764) | — |
| 5-4 | 0.0979 | (.037) | 0.2003 | (.0751) | — |
| 5-5 | 2.567 | (1.10) | 0.4090 | (.1387) | 8.144 |

TABLE II-continued

| Test No. | TEA | (S.D.) | TL | (S.D.) | EF |
|---|---|---|---|---|---|
| | Sample 6 (Run 6) BW = 373.7 N = 3 | | | | |
| 6-1 | 0.1168 | (.005) | 0.2058 | (.0186) | — |
| 6-2 | 0.0973 | (.008) | 0.1945 | (.0182) | — |
| 6-3 | 0.0912 | (.009) | 0.1883 | (.0188) | — |
| 6-4 | 0.0878 | (.009) | 0.1838 | (.0187) | — |
| 6-5 | 2.348 | (.494) | 0.3785 | (.0530) | 8.106 |
| | Sample 7 (Run 7) BW = 748.5 N = 2 | | | | |
| 7-1 | 0.0803 | (.005) | 0.1383 | (.0052) | — |
| 7-2 | 0.0628 | (.003) | 0.1292 | (.0045) | — |
| 7-3 | 0.0582 | (.002) | 0.1251 | (.0040) | — |
| 7-4 | 0.0553 | (.002) | 0.1215 | (.0036) | — |
| 7-5 | 0.9591 | (.119) | 0.2195 | (.0025) | 5.701 |

Good elastic properties for the elastomeric nonwoven webs of runs 1 through 7 are indicated by the fact that after repeated elongations and relaxations it still required the input of significant energy to elongate the material, and on the fifth stretch significant percent elongations at failure were obtained.

The elastomeric materials of the present invention, whether formed by extruding or molding, find use generally wherever elastomeric materials are useful. The elastomeric materials of the invention may be in the form of thin films, e.g., films of thickness measured in mils, say up to about 25 mils, preferably, from about 0.1 to 10 or so mils thickness, e.g., from about 1 to 3 mils, or in the form of elastomeric nonwoven webs of elastomeric fibers of low basis weight, for example, up to about 350 grams per square meter, say about 10 to 250 grams per square meter. The thin films may be formed by substituting a conventional film-forming die for the meltblowing die described above and heating the A-B-A′ block copolymer, defined above, to at least about 290 degrees Centigrade to about 345 degrees Centigrade. For example, from about 300 degrees Centigrade to about 335 degrees Centigrade to melt the block copolymer to form it into an extrudable composition which is then extruded in sheet form from the extrusion slot or gap of the film-forming die, for example, as a molten sheet. Thereafter, the molten sheet may be drawn down by a conventional arrangement to reduce the thickness of the sheet and thus form the film. Then the film is cooled by, for example, quenching in a water bath.

In such thin film or low basis weight form, the elastomeric materials are relatively inexpensive per unit area of material and may be utilized in providing disposable elasticized fabrics either by themselves or by being bonded to other materials such as, for example, non-elastic gatherable materials. The non-elastic gatherable materials may be, for example, gatherable webs of nonwoven fibers such as polyolefin, e.g., polypropylene, polyester, cellulosic, e.g., cotton, fibers. Such lightweight construction provides elasticized materials which are inexpensive enough for use in disposable garments and articles, by which is meant garments are articles designed to be discarded after one or a few uses rather than being repeatedly laundered and reused. The materials of the invention may also be provided as much thicker films and heavier basis weights, the latter being exemplified by samples 6 and 7 of Table II above. This application is one of a group of applications which are being filed on the same date. The group includes U.S. patent application Ser. No. 760,437 of J. D. Taylor et al, entitled "Composite Elastomeric Material And Process For Making The Same"; U.S. patent application Ser. No. 760,438, now U.S. Pat. No. 4,655,71 M. T. Morman et al, entitled "Elasticized Garment And Method Of Making The Same"; U.S. patent application Ser. No. 760,449, now U.S. Pat. No. 4,657,802, of M. T. Morman, entitled "Composite Nonwoven Elastic Web"; and U.S. pat. application Ser. No. 760,445, now U.S. Pat. No. 4,652,487, of M. T. Morman, entitled "Gathered Fibrous Nonwoven Elastic Web"; U.S. pat. application Ser. No. 760,698 in the name of M. T. Morman and T. J. Wisneski entitled "Polyolefin-Containing Extrudable Compositions and Methods for Their Formation into Elastomeric Products"; U.S. Pat. application Ser. No. 760,366 in the name of M. T. Morman and T. J. Wisneski entitled "High Temperature Method of Making Elastomeric Material and Materials Obtained Thereby"; and U.S. patent application Ser. No. 760,691, now abandoned in the name of William B. Haffner, Micheal T. Morman and T. J. Wisneski entitled "Block Copolymer-Polyolefin Elastomeric Films." The disclosure of each of these foregoing applications is hereby incorporated by reference.

While the invention has been described in detail with respect to specific preferred embodiments thereof, it will be appreciated that those skilled in the art, upon attaining an understanding of the foregoing, may readily conceive of alterations to and variations of the preferred embodiments. Such alterations and variations are believed to fall within the scope and spirit of the invention and the appended claims.

What is claimed is:

1. A nonwoven elastomeric material comprising a coherent matrix of entangled elastomeric fibers having a diameter of from about 0.5 micron to about 100 microns, said fibers consisting essentially of an A-R-A′ block copolymer where A and A′ are each a thermoplastic endblock containing a styrenic moiety and B is a poly(ethylene-butylene) midblock.

2. The nonwoven elastomeric material of claim 1, wherein each of A and A′ is selected from the group consisting of polystyrene and polystyrene homologs.

3. The nonwoven elastomeric material of claim 1, wherein each of A and A′ is selected from the group consisting of polystyrene and poly(alpha methylstyrene).

4. The nonwoven elastomeric material of claims 1 or 2, wherein the fibers are essentially continuous about 1 micron to about 50 microns.

5. The nonwoven elastomeric material of claims 1 or 2, wherein the fibers are essentially continuous fibers.

6. The nonwoven elastomeric material of claim 2, wherein the sum of the molecular weight of A with the molecular weight of A′ comprises from about 14 percent to about 29 percent, by weight, of the molecular weight of A-B-A′ block copolymer.

7. A nonwoven elastomeric material comprising a coherent matrix of entangled elastomeric fibers having a diameter of from about 0.5 micron to about 100 microns, said fibers consisting essentially of an A-B-A′ block copolymer where A and A′ are each a thermoplastic endblock containing a styrenic moiety and B is a poly(ethylene-butylene) midblock and where the sum of the molecular weight of A with the molecular weight of A′ comprises from about 14 percent to about 29 percent, by weight, of the molecular weight of the A-B-A′ block copolymer.

8. The nonwoven elastomeric material of claim 7, wherein each of A and A′ is selected from the group consisting of polystyrene and polystyrene homologs.

9. The nonwoven elastomeric material of claim 7, wherein each of A and A′ is selected from the group consisting of polystyrene and and poly(alpha methylstyrene).

10. The nonwoven elastomeric material of claim 8 or 9, wherein the fibers have a diameter of from about 1 micron to about 50 microns.

11. The nonwoven elastomeric material of claims 8 or 9, wherein the fibers are essentially continuous fibers.

12. The nonwoven elastomeric material of claims 8 or 9, wherein the sum of the molecular weight of A with the molecular weight of A′ comprises about 14 percent, by weight, of the molecular weight of the A-B-A′ block copolymer.

* * * * *

UNITED STATES PATENT AND TRADEMARK OFFICE

CERTIFICATE OF CORRECTION

PATENT NO. : 4,692,371

DATED : September 8, 1987

INVENTOR(S) : Michael T. Morman and Tony J. Wisneski

It is certified that error appears in the above—identified patent and that said Letters Patent is hereby corrected as shown below:

Column 1, line 55 "throughout" should read --throughput--

Column 2, line 68 "Farh-" should read --Fahr- --

Column 5, line 34 "345+ C" should read --345°C--

Column 7, line 26 "sucha s" should read --such as--

Column 8, line 32 "formina" should read --forming--

Column 8, line 58 "ration" should read --ratio--

Column 9, line 3 "0.81" should read --0.91--

Column 14, line 16 "Micheal" should read --Michael"

Column 14, line 33 "A-R-A'" should read -- A-B-A' --

Column 14, line 45 "are essentially continuous" should read --have a diameter of from--

Signed and Sealed this

Twelfth Day of April, 1988

*Attest:*

*Attesting Officer*

DONALD J. QUIGG

*Commissioner of Patents and Trademarks*